US011363842B2

(12) United States Patent
Miles et al.

(10) Patent No.: US 11,363,842 B2
(45) Date of Patent: Jun. 21, 2022

(54) GARMENT, ESPECIALLY SPORTS GARMENT

(71) Applicant: PUMA SE, Herzogenaurach (DE)

(72) Inventors: Baljinder Kaur Miles, Herzogenaurach (DE); Jordi Beneyto-Ferre, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 265 days.

(21) Appl. No.: 16/307,336

(22) PCT Filed: Apr. 24, 2017

(86) PCT No.: PCT/EP2017/000505
§ 371 (c)(1),
(2) Date: Dec. 5, 2018

(87) PCT Pub. No.: WO2018/196939
PCT Pub. Date: Nov. 1, 2018

(65) Prior Publication Data

US 2019/0133213 A1 May 9, 2019

(51) Int. Cl.
*A41D 13/005* (2006.01)
*A41D 31/04* (2019.01)

(52) U.S. Cl.
CPC ..... *A41D 13/005* (2013.01); *A41D 31/04* (2019.02); *A41D 2400/10* (2013.01); *A41D 2600/10* (2013.01)

(58) Field of Classification Search
None
See application file for complete search history.

(56) References Cited

U.S. PATENT DOCUMENTS

2006/0276089 A1 12/2006 Amarasinghe
2010/0015869 A1* 1/2010 Hartmann ..... D06M 15/273 442/59
2013/0263352 A1* 10/2013 Crockett, Jr. ..... A41D 31/18 2/69
2014/0366238 A1 12/2014 Owen
2015/0177423 A1 6/2015 Scipioni

FOREIGN PATENT DOCUMENTS

AU 2014201839 A 4/2015
AU 2014201839 B1 4/2015
CN 1695507 A 11/2005
EP 0751010 A1 1/1977
(Continued)

*Primary Examiner* — Shawn McKinnon
(74) *Attorney, Agent, or Firm* — Lucas & Mercanti, LLP; Klaus P. Stoffel

(57) ABSTRACT

A garment, especially to a sports garment, including a textile substrate which covers a part of the body of the wearer of the garment, wherein at least a section of the textile substrate is coated with at least two different Phase Change Materials, wherein a first Phase Change Material is arranged which has a phase transition temperature between 27° C. and 29° C., wherein a second Phase Change Material is arranged which has a phase transition temperature between 35° C. and 37° C., wherein both of the Phase Change Materials are in thermal contact with at least one thermochromic dye. By doing so, an improved thermal regulation during sporting activities is obtained which can be controlled visually.

11 Claims, 4 Drawing Sheets

(56) References Cited

FOREIGN PATENT DOCUMENTS

| | | | |
|---|---|---|---|
| EP | 1314802 | A1 | 5/2003 |
| JP | 2007528945 | A | 10/2007 |
| KR | 100949887 | B1 | 3/2010 |
| KR | 20100120591 | A | 11/2010 |
| KR | 1020100120591 | A1 | 11/2010 |
| KR | 20100126618 | A | 12/2010 |

* cited by examiner

GARMENT, ESPECIALLY SPORTS GARMENT

CROSS-REFERENCE TO RELATED APPLICATION

The present application is a 371 of International application PCT/EP2017/000505, filed Apr. 24, 2017, the priority of this application is hereby claimed and this application is incorporated herein by reference.

BACKGROUND OF THE INVENTION

The invention relates to a garment, especially to a sports garment, comprising a textile substrate which covers a part of the body of the wearer of the garment.

Garment is usually used to keep the body of the wearer at a desired temperature. During physical exercise the body temperature changes within a certain range significantly. An illustration is given in FIG. 1. Here the curve of the body temperature of an athlete is shown over the time of physical training. An optimal comfort zone is depicted for the body temperature. During the warm up phase the body temperature rises. The temperature becomes high during physical exercise and a corresponding activity level. After the exercise the body temperature drops in the cool down phase.

SUMMARY OF THE INVENTION

It is an object of the present invention to propose a garment of the kind mentioned above which better stabilizes the body temperature within the mentioned comfort zone. Also it is aimed for to allow a certain visual monitoring of the body temperature situation of the athlete. Thus, an improved thermal regulation during sporting activities is aimed for which can be controlled visually in an easy manner.

The solution of this object according to the invention is characterized in that at least a section of the textile substrate is coated with at least two different Phase Change Materials, wherein a first Phase Change Material is arranged which has a phase transition temperature between 27° C. and 29° C., wherein a second Phase Change Material is arranged which has a phase transition temperature between 35° C. and 37° C., wherein both of the Phase Change Materials are in thermal contact with at least one thermochromic dye.

The Phase Change Materials are preferably contained in micro-capsules.

Thereby, it is possible that the same thermochromic dye is in thermal contact with the first and the second Phase Change Materials. Alternatively, a first thermochromic dye is in thermal contact with the first Phase Change Material and a second thermochromic dye, which is different from the first thermochromic dye, is in thermal contact with the second Phase Change Material.

The thermochromic dye can be mixed with the first and/or the second Phase Change Material. Alternatively, the thermochromic dye can be applied as a layer onto the first and/or the second Phase Change Material. A further alternative concept provides that the thermochromic dye is applied onto one surface of the textile substrate and that the first and/or the second Phase Change Materials are applied onto the other opposite surface of the textile substrate.

The first and the second Phase Change Materials are preferably arranged at the same side of the textile substrate. In this case the first and the second Phase Change Materials can be arranged as layers on the textile substrate, wherein the layers do not overlap. A preferred embodiment of the invention proposes that at least in some regions of the textile substrate the layers of the first and the second Phase Change Materials form complementary areas which cover the textile substrate in the region substantially completely.

As an alternative it is also possible that the first Phase Change Material is arranged at one side of the textile substrate and that the second Phase Change Material is arranged at the other side of the textile substrate. The complementary arrangement of the Phase Change Materials as mentioned above can also be provided accordingly in this case.

The first and the second Phase Change Materials can be arranged in a region of the textile substrate which covers during intended use of the garment the radial artery, the dorsal region, the brachial artery and/or the popliteal artery of the wearer.

The textile substrate can comprise synthetic fibers, especially of polyester, polyamide or elastane. Also, the textile substrate can comprise natural fibers, especially of cotton.

The first and the second Phase Change Materials have been preferably applied onto the surface of the textile substrate by means of a printing process. In this case it can be provided that the first and the second Phase Change Materials have been applied onto the surface in more than one layer, for example in three layers.

Thus, the invention proposes the use of at least two specific kinds of Phase Change Materials, wherein the use of thermochromic dye (which is preferably mixed with the Phase Change Material) allows the visual indication of the temperature situation of the body of the athlete.

Phase Change Materials (PCM) are well known in the art as such. Such a material is a substance with a high heat of fusion which, melting and solidifying at a certain temperature, is capable of storing and releasing certain amounts of energy. Heat is absorbed or released when the material changes from solid to liquid and vice versa; thus a PCM functions as a latent heat storage element.

When the PCM reaches the temperature at which it changes its phase (i. e. the melting temperature) it absorbs large amounts of heat at an almost constant temperature. The PCM continues to absorb heat without a significant rise in temperature until all the material is transformed to the liquid phase. When the ambient temperature around a liquid material falls, the PCM solidifies, releasing its stored latent heat.

PCMs are available basically for all required temperature ranges from −5° C. up to +190° C., so the PCM can easily be composed with respect to its composition to exactly meet the above mentioned temperature specification. Thereby, the most commonly used PCMs are salt hydrates, fatty acids and esters and various paraffins (such as octadecane).

As most of the organic solutions are water-free, they can be exposed to air, but all salt based PCM solutions must be encapsulated to prevent water evaporation or uptake. In the case of the above mentioned preferred micro-encapsulation the PCM is arranged in a protective coating.

Also thermochromic dyes are well known in the art. Generally, thermochromism is the property of substances to change their color due to a change in temperature. A thermochromic dye (also called thermochromic ink) is a temperature sensitive compound which temporarily changes its color with exposure to heat. It is available in the form of liquid crystals and leuco dyes. Explicitly reference is made to AU 2014201839 B1 which describes details with respect to the mentioned material.

Thus, the proposed concept provides a method to thermoregulate the body temperature of an athlete during exercise by the use of a piece of garment which includes Phase Change Materials, i. e. a chemical agent which absorbs heat when the temperature goes up, stores this energy temporarily, and releases the energy as heat when the temperature cools down. Those materials are used in combination with an ink capable of reacting to temperature changes, i. e. with a thermochromic dye.

For the thermoregulation (at least) two different types of microencapsulated Phase Change Materials are used, the first one experiencing the phase transition at preferably 28° C. and the second experiencing the phase transition at preferably 36° C. Said phase change will be visualized by the use of the added thermochromic dye (thermochromic ink) which will preferably turn transparent when in contact with bodies at a temperature between 28° C. and 36° C.

The aim of the use of two phase transition temperatures is to cater to the oscillating nature of the human body temperature during physical exercise, with the first PCM with the transition temperature between 27° C. and 29° C. (28° C.) being effective on the first contact with the skin (due to the temperature drop from 33° C., which is the average typical human skin temperature) and the second PCM with the transition temperature between 35° C. and 37° C. (36° C.) becoming effective once the users body temperature rises during the sporting activity.

The arrangement or the application of the PCM is preferably done in the following manner:

A screen print will be placed on the textile substrate of the garment in a fashion in which key thermo-regulative points on the body (pulse points) are directly affected by the capacity of the Phase Change Material to absorb heat when the temperature goes up, store this energy temporarily, and release the energy as heat when the temperature cools down.

These key points can be located on the radial artery, the temporal artery, the brachial artery and the popliteal artery (due to the more superficial nature of this blood vessel and in order to make the effect of the PCM more noticeable and effective for the user). Also, the dorsal region is relevant, because this being a zone rich in nerve receptors, hence maximizing the effect of the PCM.

With respect to the production method of the mentioned garment the following specification should be given: The thermoregulation agent, i. e. the PCM, in combination with the thermochromic dye will be printed onto the textile substrate made of a combination of synthetic fibers such as polyester, polyamide or elastane, or of a combination of natural and synthetic fibers such as cotton and polyester or cotton and elastane.

The two different PCM types are applied as different layers of the same graphic, in the fashion that each PCM is colored in a different color. The print can be composed of up to three superimposed layers of PCM plus thermochromic dye print as to ensure a perfect relationship between the latent heat capacity and the PCM material and the textile substrate drape and hand feel.

Different variations of the above described concept can be of interest:

Generally, there will be two different types of PCM each mixed with a different color of thermochromic dye. It is also possible that both PCMs are mixed with the same thermochromic dye but different concentrations of said thermochromic dye are applied to each PCM in order to achieve different tones of the same color.

The two distinct PCMs are arranged basically side by side to each other (as mentioned above: preferably in a complementary arrangement). Thus, one PCM fits or fills the gaps which have been left when applying the other PCM; the final result is that the two PCMs are placed complementary side by side.

The two different layers of the mixture of PCM and thermochromic dye can be applied on the inner side of the garment thus facing the skin of the wearer. But it is not excluded that the material is applied on the outside of the garment.

A further alternative proposes that the two different types of PCM are applied on the inner side of the garment (facing the skin of the wearer) and that the thermochromic dye is applied as a layer on the outer side of the garment.

BRIEF DESCRIPTION OF THE DRAWING

In the drawings an embodiment of the invention is shown.

DETAILED DESCRIPTION OF THE INVENTION

Figure 1:
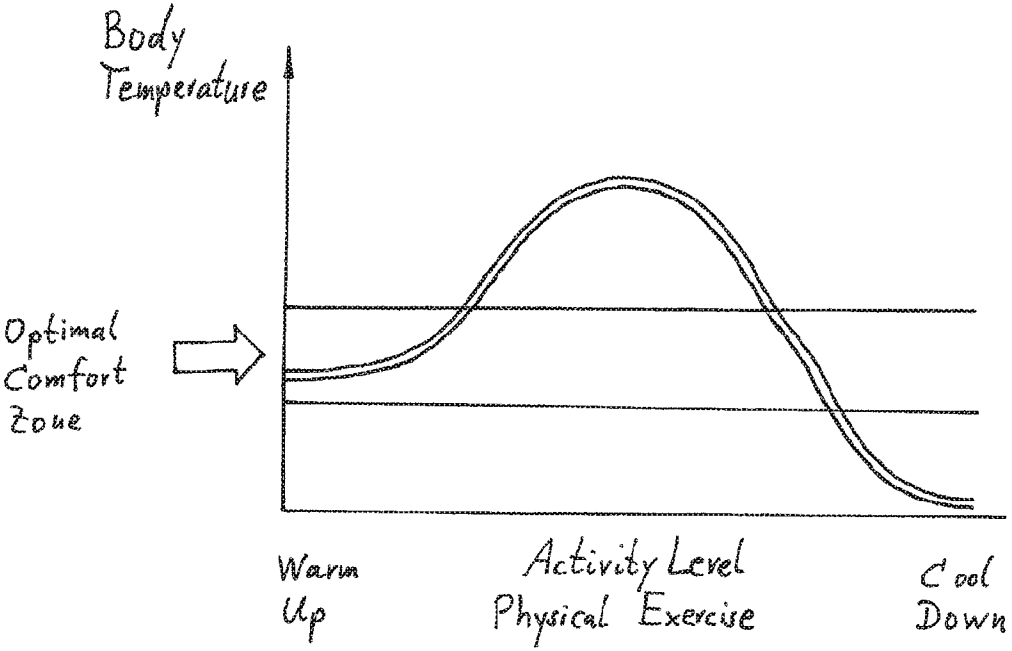
FIG. 1 shows a schematic curve of physical activity of an athlete during physical training.
Figure 2:
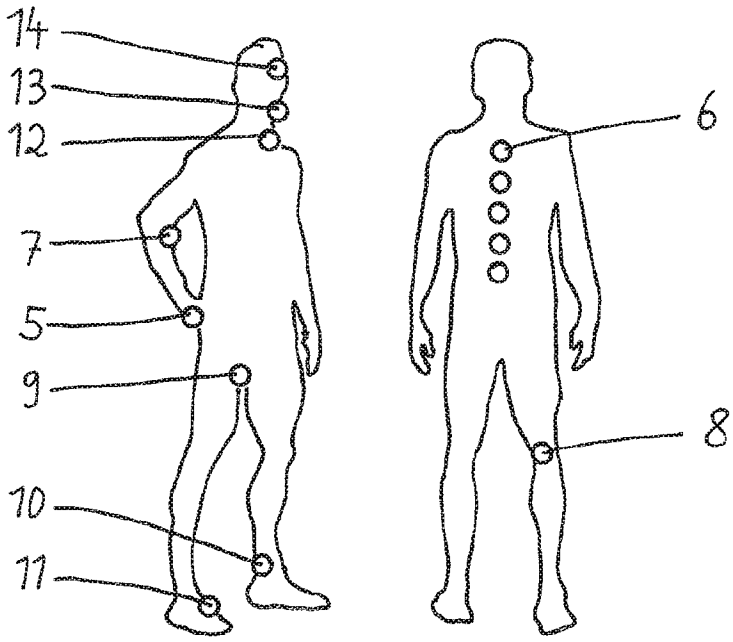
FIG. 2 shows relevant locations of the body of an athlete which are specific subject of thermoregulation during physical training.

Reference is made to the above comments in connection with FIG. 1. In FIG. 2 is can be seen which specifically relevant locations at the body of a wearer of a sports garment require preferably efficient thermal regulation.

Of specific relevance are the radial artery 5, the dorsal region 6, the brachial artery 7 and the popliteal artery 8.

Other relevant location can be the femoral artery 9, the posterior tibial artery 10, the dorsalis pedis artery 11, the carotid artery 12, the facial artery 13 and the temporal artery 14.

Figure 3:
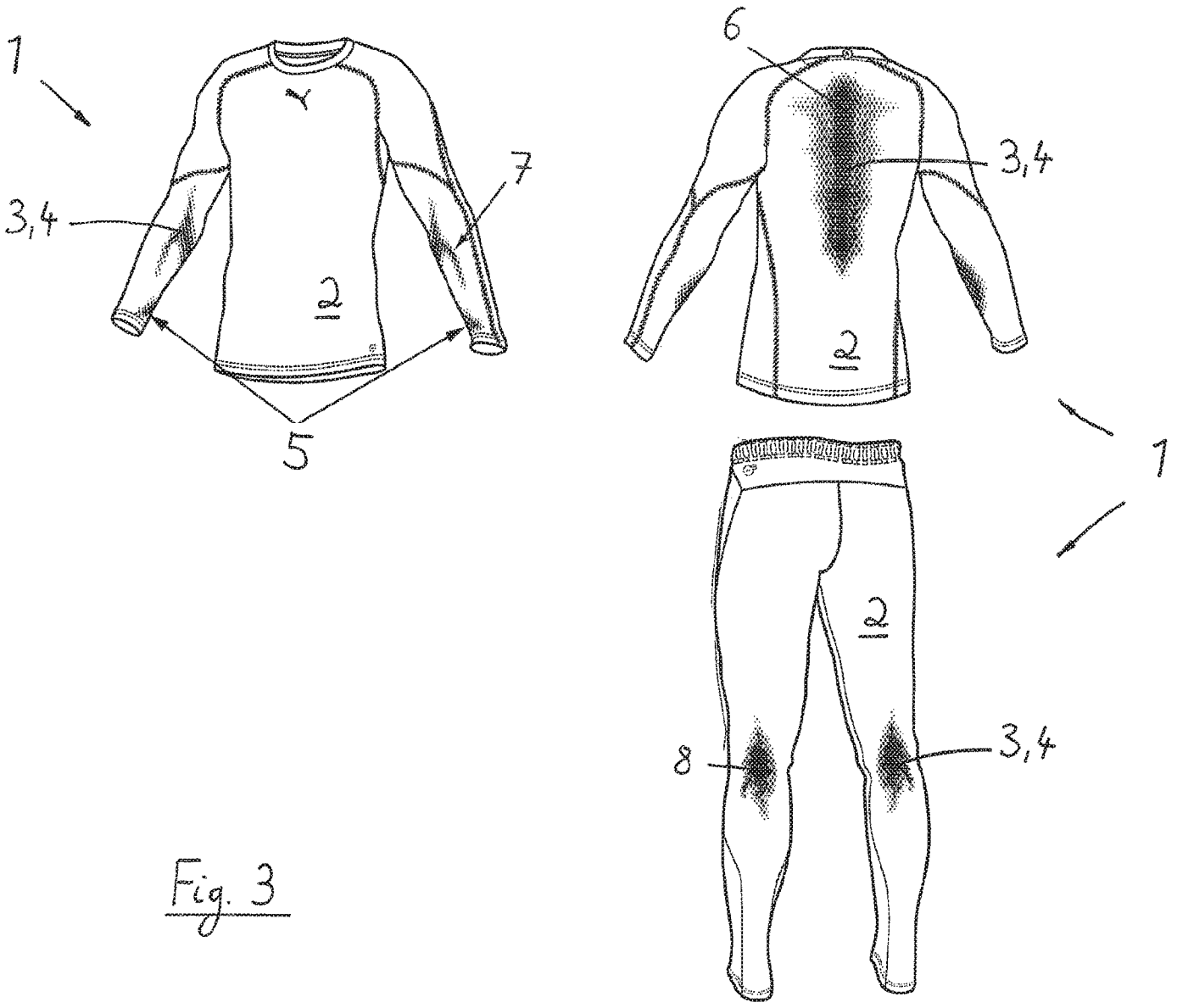
FIG. 3 shows a piece of garment, namely a top and a bottom part of a sports suit according to the invention.

The improved thermoregulation according to the invention is carried out with a garment 1, especially with a sports garment, as shown exemplary in FIG. 3. An upper part of the garment is shown in a front view in the left region of FIG. 3. The corresponding rear view is depicted in the right region of the figure. The bottom part (trousers) of the garment 1 is shown in a rear view in the right lower region of FIG. 3.

In some of the above mentioned regions, namely in the area of the radial artery 5, in the dorsal region 6, in the area of the brachial artery 7 and in the area of the popliteal artery 8 (all regions are to be understood when the garment 1 is worn by the user in the intended manner), the textile substrate 2 of the garment is provided with the above mentioned special thermoregulating Phase Change Materials 3 and 4, which are in the present case mixed with two distinct thermochromic dyes (thermochromic inks).

More specifically, the mentioned sections of the textile substrate 2 are coated by means of a printing process with the two different Phase Change Materials 3 and 4.

The first Phase Change Material 3 has a phase transition temperature between 27° C. and 29° C., preferably of 28° C.; the second Phase Change Material 4 has a phase transition temperature between 35° C. and 37° C., preferably of 36° C.

Furthermore, into the two Phase Change Materials 3, 4 a respective thermochromic dye is mixed to make it possible to observe the thermal situation of the wearer of the garment 1 during physical activity.

As the arrangement of the two Phase Change Materials is located at the mentioned arteries an efficient cooling effect can be obtained.

A preferred detailed arrangement of the two Phase Change Materials is depicted in FIG. 4.

Figure 4C:
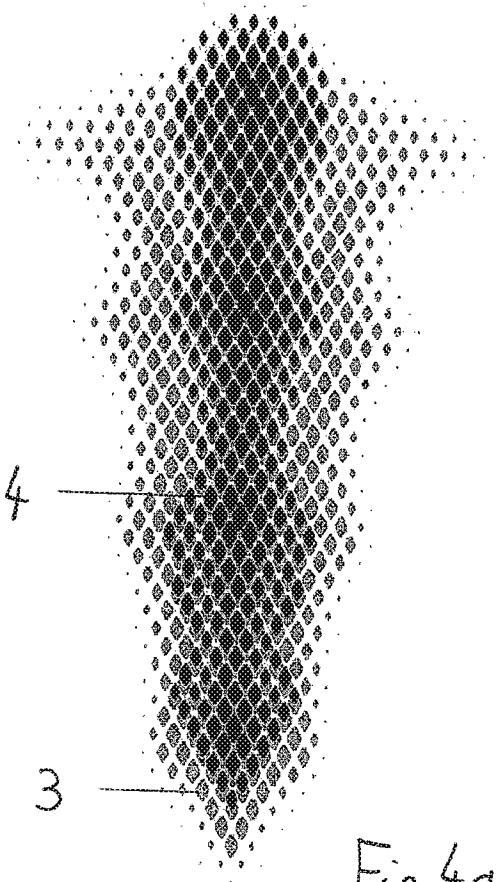
FIG. 4*b* shows a pattern of the application of a second Phase Change Material onto the textile substrate and FIG. 4*c* shows the superposition of both patterns according to FIG. 4*a* and FIG. 4*b* onto the textile substrate.
Figure 4B:
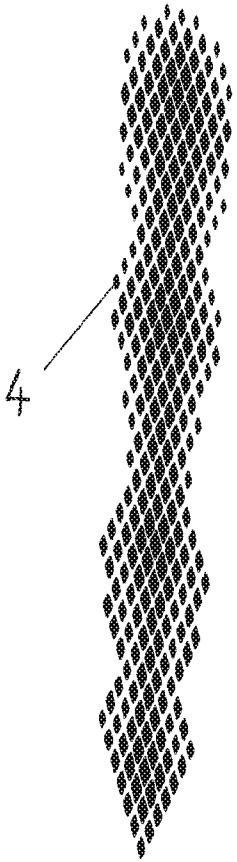
Figure 4A:
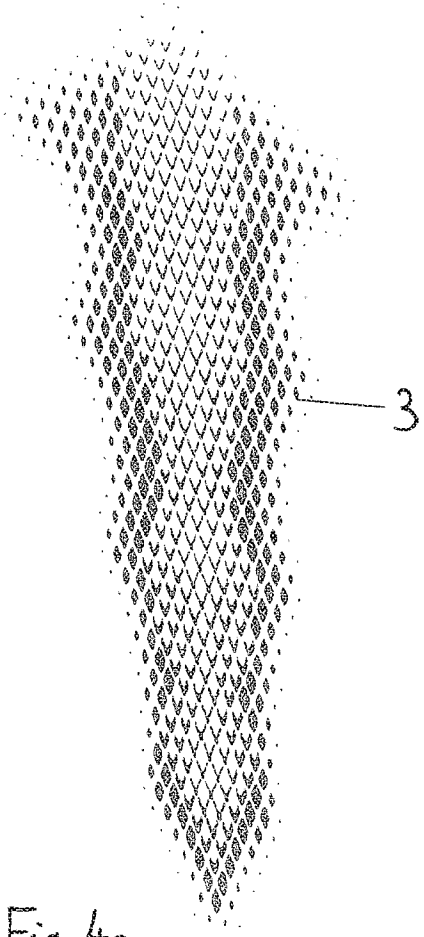
FIG. 4*a* shows a pattern of the application of a first Phase Change Material onto a textile substrate.

In FIG. 4*a* the pattern is shown in which the first Phase Change Material 3 is printed onto the surface of the textile substrate 2 of the garment 1. Here a preferred pattern for the dorsal region 6 is shown; generally the same applies for the other mentioned regions.

As can be seen the pattern comes up with some rhombic areas and other areas which are shaped like an arrowhead. Thus, certain areas between the areas covered with the first Phase Change Material 3 remain free.

Then, the pattern consisting of the second Phase Change Material 4 is applied as depicted in FIG. 4*b*. Basically, this pattern is complementary to that one of FIG. 4*a*.

After the application (printing) of the pattern of the second Phase Change Material 4 the final pattern is given as shown in FIG. 4*c*. As can be seen here the textile substrate 2 is now—at least in some regions—completely covered by the two Phase Change Materials 3 and 4, wherein the two materials 3, 4 do not overlap but form complementary shapes. Only small rims can remain uncovered (see white gaps between the areas of Phase Change Materials 3 and 4).

For example, the shown area according to FIG. 4*c* can cover an area with a width of about 250 mm to 350 mm and a height of 400 mm to 550 mm in the dorsal region 6.

During use and in the meaning of FIG. 1 at first during warm up at low intensity of the physical activity is given and the garment has at first a temperature of approximately room temperature (e. g. 20° C.). At moderate physical activity the temperature is rising. Here, the first Phase Change Material reaches its phase transition temperature of 28° C. and thus a cooling effect is obtained.

At a high activity level the thermoregulation effect is intensified as now the second Phase Change Material reaches its transition temperature of 36° C. At decreasing physical activity (cool down) the process is reversed.

REFERENCE NUMERALS

1 Garment (sports garment)
2 Textile substrate
3 First Phase Change Material (PCM; 28° C.)
4 Second Phase Change Material (PCM; 36° C.)
5 Radial artery
6 Dorsal region
7 Brachial artery
8 Popliteal artery
9 Femoral artery
10 Posterior tibial artery
11 Dorsalis pedis artery
12 Carotid artery
13 Facial artery
14 Temporal artery

The invention claimed is:

1. A garment, comprising a textile substrate which covers a part of the body of the wearer of the garment, wherein at least a section of the textile substrate is coated with at least two different Phase Change Materials, wherein a first Phase Change Material is arranged which has a phase transition temperature between 27° C. and 29° C., wherein a second Phase Change Material is arranged which has a phase transition temperature between 35° C. and 37° C., wherein both of the Phase Change Materials are in thermal contact with at least one thermochromic dye, wherein the first and the second Phase Change Materials are applied only on an inner side of the garment facing a wearer's skin and the thermochromic dye is applied on an outer side of the garment, wherein the first and the second Phase Change Materials are arranged as layers on the textile substrate, wherein the layers do not overlap, and wherein at least in some regions of the textile substrate the layers of the first and the second Phase Change Materials form complementary areas which cover the textile substrate in the region substantially completely.

2. The garment according to claim 1, wherein the Phase Change Materials are contained in micro-capsules.

3. The garment according to claim 1, wherein the same thermochromic dye is in thermal contact with the first and the second Phase Change Materials.

4. The garment according to claim 1, wherein a first thermochromic dye is in thermal contact with the first Phase Change Material and that a second thermochromic dye, which is different from the first thermochromic dye, is in thermal contact with the second Phase Change Material.

5. The garment according to claim 1, wherein the first and the second Phase Change Materials are arranged in a region of the textile substrate which covers during intended use of the garment the radial artery, the dorsal region, the brachial artery and/or the popliteal artery of the wearer.

6. The garment according to claim 1, wherein the textile substrate comprises synthetic fibers.

7. The garment according to claim 1, wherein the textile substrate comprises natural fibers.

8. The garment according to claim 1, wherein the first and the second Phase Change Materials have been applied onto the surface of the textile substrate by means of a printing process.

9. The garment according to claim 8, wherein the first and the second Phase Change Materials have been applied onto the surface in more than one layer.

10. The garment according to claim 6, wherein the textile substrate comprises polyester, polyamide or elastane fibers.

11. The garment according to claim 7, wherein the textile substrate comprises cotton fibers.

* * * * *